US011267609B2

(12) United States Patent
Pfeifer et al.

(10) Patent No.: US 11,267,609 B2
(45) **Date of Patent: *Mar. 8, 2022**

(54) STACKABLE PALLET DISPLAY

(71) Applicants: Menasha Corporation, Neenah, WI (US); PepsiCo, Inc., Purchase, NY (US)

(72) Inventors: Mike Pfeifer, Hartford, WI (US); William Garrett Ehlebracht, Naperville, IL (US); Sunitha Nair, Dallas, TX (US); Daniel Lee Mathews, McKinney, TX (US); Roberto Carlos Guerrero Kees, Frisco, TX (US)

(73) Assignees: Menasha Corporation, Neenah, WI (US); PepsiCo, Inc., Purchase, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/914,586

(22) Filed: Jun. 29, 2020

(65) Prior Publication Data

US 2020/0385170 A1 Dec. 10, 2020

Related U.S. Application Data

(63) Continuation of application No. 16/405,370, filed on May 7, 2019, now Pat. No. 10,745,171, which is a (Continued)

(51) Int. Cl.
*B65D 19/00* (2006.01)

(52) U.S. Cl.
CPC ..... *B65D 19/0012* (2013.01); *B65D 2519/00019* (2013.01); *B65D 2519/00034* (2013.01);
(Continued)

(58) Field of Classification Search
CPC ..... B65D 19/0012; B65D 2519/00019; B65D 2519/00054; B65D 2519/00089; B65D 2519/00223; B65D 2519/00228; B65D 2519/00243; B65D 2519/00278; B65D 2519/00373; B65D 2519/0087; B65D 2519/0097; B65D 5/006; B65D 5/0075; B65D 5/48028; B65D 5/48032;
(Continued)

(56) References Cited

U.S. PATENT DOCUMENTS 2,475,107 A 7/1949 Newsom
3,055,573 A * 9/1962 Carter ..... B65D 5/002 229/178

(Continued)

OTHER PUBLICATIONS

Rhythm Superfoods, Photographs of product display sold by Rhythm Superfoods, manufacturer of display unknown, employee of Menasha Corporation became aware of display in Aug. 2020, 5 pages.

*Primary Examiner* — Daniel J Rohrhoff
(74) *Attorney, Agent, or Firm* — Greensfelder, Hemker & Gale, P.C.; Richard C. Himelhoch

(57) ABSTRACT

A stackable pallet display system includes a tray portion having a rectangular bottom wall, corner posts extending upward from corners of the tray portion and an interior divider panel extending upward from the tray portion. The tray, corner posts and interior divider wall of the system can be folded from blanks of material.

12 Claims, 16 Drawing Sheets

Related U.S. Application Data continuation of application No. 15/061,239, filed on Mar. 4, 2016, now Pat. No. 10,315,798.

(60) Provisional application No. 62/182,710, filed on Jun. 22, 2015.

(52) U.S. Cl.
CPC ..... *B65D 2519/00054* (2013.01); *B65D 2519/00069* (2013.01); *B65D 2519/0087* (2013.01); *B65D 2519/00089* (2013.01); *B65D 2519/0097* (2013.01); *B65D 2519/00104* (2013.01); *B65D 2519/00228* (2013.01); *B65D 2519/00243* (2013.01); *B65D 2519/00268* (2013.01); *B65D 2519/00273* (2013.01); *B65D 2519/00278* (2013.01); *B65D 2519/00288* (2013.01); *B65D 2519/00318* (2013.01); *B65D 2519/00373* (2013.01); *B65D 2519/00562* (2013.01); *B65D 2519/00567* (2013.01); *B65D 2519/00815* (2013.01); *B65D 2519/00965* (2013.01)

(58) Field of Classification Search
CPC ..... B65D 5/48034; B65D 5/48036; B65D 5/48044; B65D 5/48048
See application file for complete search history.

(56) References Cited

U.S. PATENT DOCUMENTS 3,283,989 A 11/1966 De Paul
3,404,804 A 10/1968 Frater et al.
3,420,402 A 1/1969 Frater et al.
4,209,125 A 6/1980 Helms
4,282,999 A * 8/1981 Moen ..... B31D 5/0004 206/427
4,330,078 A 5/1982 Graser
4,372,444 A 2/1983 Le Grand et al.
4,605,158 A * 8/1986 Barton ..... B65D 5/48028 229/120.23
4,858,774 A 8/1989 Winter et al.
5,839,650 A 11/1998 Sheffer
5,947,292 A 9/1999 Chelfi
5,992,735 A 11/1999 Oosterbaan
6,029,886 A 2/2000 Sheffer
6,098,821 A 8/2000 Cube et al.
6,317,039 B1 11/2001 Thomason
6,378,764 B1 * 4/2002 Teixidor Casanovas ..... B65D 5/0065 206/509
6,513,705 B1 * 2/2003 Sheffer ..... B65D 5/0025 206/509
6,868,968 B1 * 3/2005 Casanovas ..... B65D 5/321 206/509
7,066,342 B2 6/2006 Baechle et al.
7,637,372 B2 * 12/2009 Keel ..... B65D 5/0025 206/509
7,823,725 B1 * 11/2010 Shupe ..... B65D 71/0096 206/386
8,567,661 B2 * 10/2013 Sullivan ..... B65D 5/48048 229/120.24
8,833,573 B2 9/2014 Tomaszewski et al.
9,138,079 B2 9/2015 Su
9,428,298 B2 * 8/2016 Bersamin ..... B65D 5/445
9,566,756 B2 2/2017 Brundage
9,580,201 B2 2/2017 Willman et al.
9,783,333 B1 * 10/2017 De Los Santos ..... B65D 5/006
9,826,843 B1 11/2017 Tomaszewski et al.
9,926,100 B2 3/2018 Adams
9,918,569 B1 8/2018 Abel
10,315,798 B2 * 6/2019 Pfeifer ..... B65D 19/0012
10,745,171 B2 * 8/2020 Pfeifer ..... B65D 19/0012
2009/0032432 A1 * 2/2009 Kostos ..... B65D 71/0096 206/600
2010/0084459 A1 * 4/2010 Little ..... B65D 5/48034 229/120.29
2013/0180941 A1 * 7/2013 Tomaszewski ..... B65D 19/385 211/126.12
2015/0076096 A1 * 3/2015 Brady ..... A47B 43/02 211/132.1
2015/0122690 A1 5/2015 Bersamin et al.
2016/0272360 A1 * 9/2016 Adams ..... B65D 5/322
2016/0368660 A1 12/2016 Pfeifer et al.
2017/0152072 A1 6/2017 Brundage
2018/0092461 A1 4/2018 Brady et al.
2018/0160825 A1 6/2018 Abel
2018/0170608 A1 6/2018 Adams
2019/0256249 A1 * 8/2019 Pfeifer ..... B65D 19/0012
2020/0024032 A1 * 1/2020 Urban ..... A47B 87/0261

* cited by examiner

STACKABLE PALLET DISPLAY

CROSS-REFERENCE TO RELATED APPLICATIONS

The present invention is a continuation of U.S. patent application Ser. No. 16/405,370 filed May 7, 2019, which is a continuation of U.S. patent application Ser. No. 15/061,239 filed Mar. 4, 2016, now U.S. Pat. No. 10,315,798, which claims the benefit of U.S. Provisional Patent Application No. 62/182,710 filed Jun. 22, 2015, the contents of which are incorporated herein by reference.

FEDERALLY SPONSORED RESEARCH OR DEVELOPMENT

N/A

FIELD OF THE INVENTION

The present invention generally relates to a foldable pallet display formed from paper, corrugated plastic or other similar material that is stackable on other like displays.

BACKGROUND OF THE INVENTION

The packaging industry is always striving to improve packaging that can be used for transportation as well as display. Such packaging solutions reduce time spent unpacking and repositioning goods.

The present system provides an improved display that can be stacked with other like displays.

SUMMARY OF THE INVENTION

The present invention provides a stackable pallet system that can also function as a store display. The pallets in the system can be formed from paper or plastic blanks of material. The blanks are folded into components of the pallet. The pallet is configured to stack with another like pallet. In the present instance, another "like" pallet means one having at least the features needed to stack and interlock with another pallet of the present invention and does not require each pallet to be identical (although an identical pallet would also be considered a "like" pallet).

The pallets include a base or tray, four corner posts and a divider panel. To facilitate stacking of the pallets, the base is provided with slots configured to receive tabs extending upward from the corner post of a lower pallet.

In accordance with one embodiment, a stackable pallet comprises a tray portion having a generally rectangular bottom wall having a first corner, second corner, third corner and fourth corner. The tray includes a first end wall, an opposing second end wall, a first side wall and an opposing second side wall. Each of the end walls and side walls is connected via fold lines to the bottom wall. The bottom wall includes a first corner slot at the first corner and a first corner slot at the second corner. The bottom wall can also include a first corner slot at the third and fourth corners.

The pallet further includes a first corner post having a first upwardly extending tab positioned at the first corner of the tray portion. The first tab of the first corner post is aligned with the first corner slot at the first corner of the bottom wall of a like pallet. The pallet further includes a second corner post having a first upwardly extending tab positioned at the second corner of the tray portion. The first tab of the second corner post is aligned with the first corner slot at the second corner of the bottom wall of a like pallet. The pallet also includes a third corner post positioned at the third corner of the tray portion and a fourth corner post positioned at the fourth corner of the tray portion. The third and fourth corner posts can also include upwardly extending first tabs and the bottom wall can include corresponding slots. Moreover, one or more of the corner posts can be provided with a second (or more) tab. In this latter configuration, the bottom wall is provided corresponding slots.

The pallet further includes a divider panel extending upward from the bottom wall of the tray portion. This panel can be used to divide goods into separate regions on the pallet.

The first corner post can be connected to a first end of a first side panel and the second corner post is connected to a second end of the first side panel to form a single piece. The first side panel can be positioned at the first side wall of the tray portion. Similarly, the third corner post can be connected to a first end of a second side panel and the fourth corner post is connected to a second end of the second side panel. The second side panel is positioned at the second side wall of the tray portion.

The divider panel can include a central panel, a first outer panel connected to a first side of the central panel, and a second outer panel connected to a second side of the central panel. Additionally, the divider panel can include a glue panel connected to a bottom side of the central panel.

The bottom wall can include a first divider slot and a second divider slot. The first outer panel of the divider panel can then include a downwardly extending tab aligned with the first divider slot and the second outer panel can include a downwardly extending tab aligned with the second divider slot.

A foldable cap can be provided. The cap can be placed on the uppermost pallet of a stack of pallets.

The tray portion, corner posts and divider of the stackable pallet can be formed from paper or plastic sheets. The sheets can be corrugated.

In accordance with a second embodiment of the invention, a stackable pallet is provided which comprises a base having a bottom wall, a first foldable end wall connected to a first end of the base, a second foldable end wall connected to a second end of the base, a first foldable side wall connected to a first side of the base and a second foldable side wall connected to a second side of the base. The base further includes a first slot in the bottom wall proximate a first end of the first end wall and a second slot in the bottom wall proximate the first end of the first side wall. The pallet further includes a first corner post having a first portion extending upward from the first end wall and a second portion extending upward from the first side wall. The first portion includes an upwardly extending tab configured to fit in the first slot in the bottom wall of a like pallet and the second portion includes an upwardly extending tab configured to fit in the second slot in the bottom wall of the like pallet.

The stackable pallet can further include a divider panel extending upward from the bottom wall. The divider panel can include a central panel, a first outer panel and a second outer panel. Additionally, the central panel of the divider panel can also include a glue panel connected to a bottom of the central panel for securing the divider panel to the base. The bottom wall can include a first divider slot and a second divider slot and the first outer panel can include a downwardly extending tab positioned in the first divider slot and the second outer panel can include a downwardly extending tab positioned in the second divider slot.

The first portion of the first corner post can include a first outer layer of material and a second inner layer of material. Similarly, the second portion of the first corner post includes a first outer layer of material and a second inner layer of material.

In accordance with a third embodiment of the invention, a display pallet is provided. The display pallet comprises a tray having a generally rectangular bottom wall, a first side wall, a second side wall, a first end wall and a second end wall. The end and side walls can be integrally connected to the bottom wall. The bottom wall includes a first divider slot. The pallet further includes a first corner post extending upward from a first corner of the bottom wall, a second corner post extending upward from a second corner of the bottom wall, a third corner post extending upward from a third corner of the bottom wall and a fourth corner post extending upward from a fourth corner of the bottom wall. A first divider extends upward from the bottom wall in the center of the bottom wall. The first divider includes a first downwardly extending tab positioned in the first divider slot in the bottom wall.

The first corner post (and the other corner posts) can be configured to have a plurality of outer walls forming a hollow interior. The outer walls of the first corner post can have a generally rectangular cross-sectional configuration, or other suitable shape.

The first corner post (again, and the other corner posts) can also include a flange extending toward an interior of the tray. The bottom wall can include a corner post slot and the flange can include a downwardly extending tab positioned in the corner post slot.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
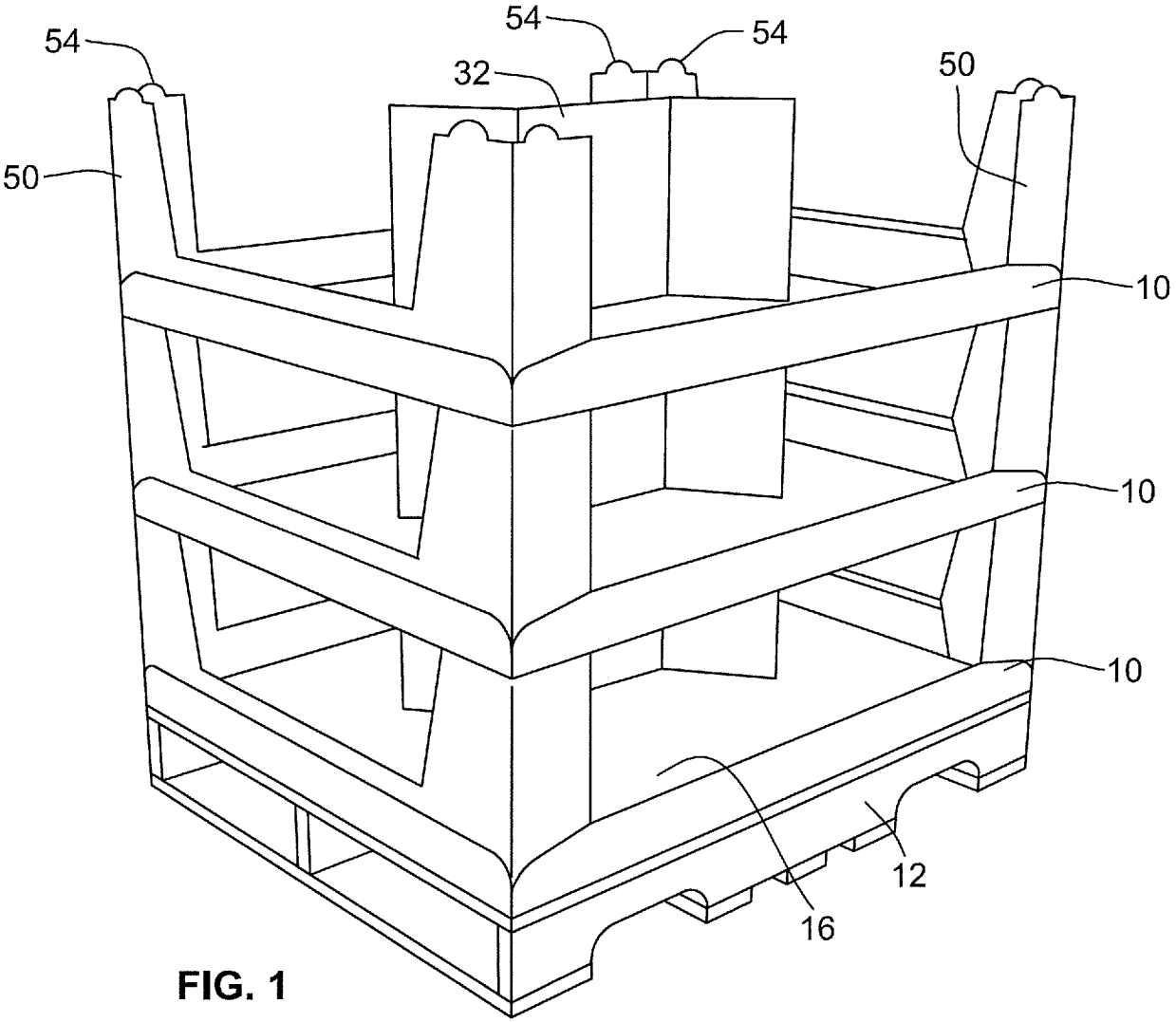
FIG. 1 is a perspective view of a stack of pallet displays in accordance with an embodiment of the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

In accordance with a first embodiment, the present invention is directed to a stackable pallet 10 formed from a paper or plastic material, such as a paper or plastic corrugated material. One or more of the pallets 10 can be placed in a store or other retail establishment and be used as a display for the goods carried on the pallets 10.

The pallet 10 is configured to stack with other like pallets 10 as shown in FIG. 1. The stack of pallets 10 is shown on a conventional wood pallet 12. The wood pallet 12 can be engaged by a fork lift for moving the stack of pallets 10 (and any goods on the pallets 10). A conventional plastic pallet, or other suitable transport mechanism, can also be used to transport the stack of pallets 10.

The pallet 10 is formed from several components. The components are formed from blanks of material (such as those shown in FIGS. 2-6). The blanks are folded and glued together to form a pallet display.

Figure 2:
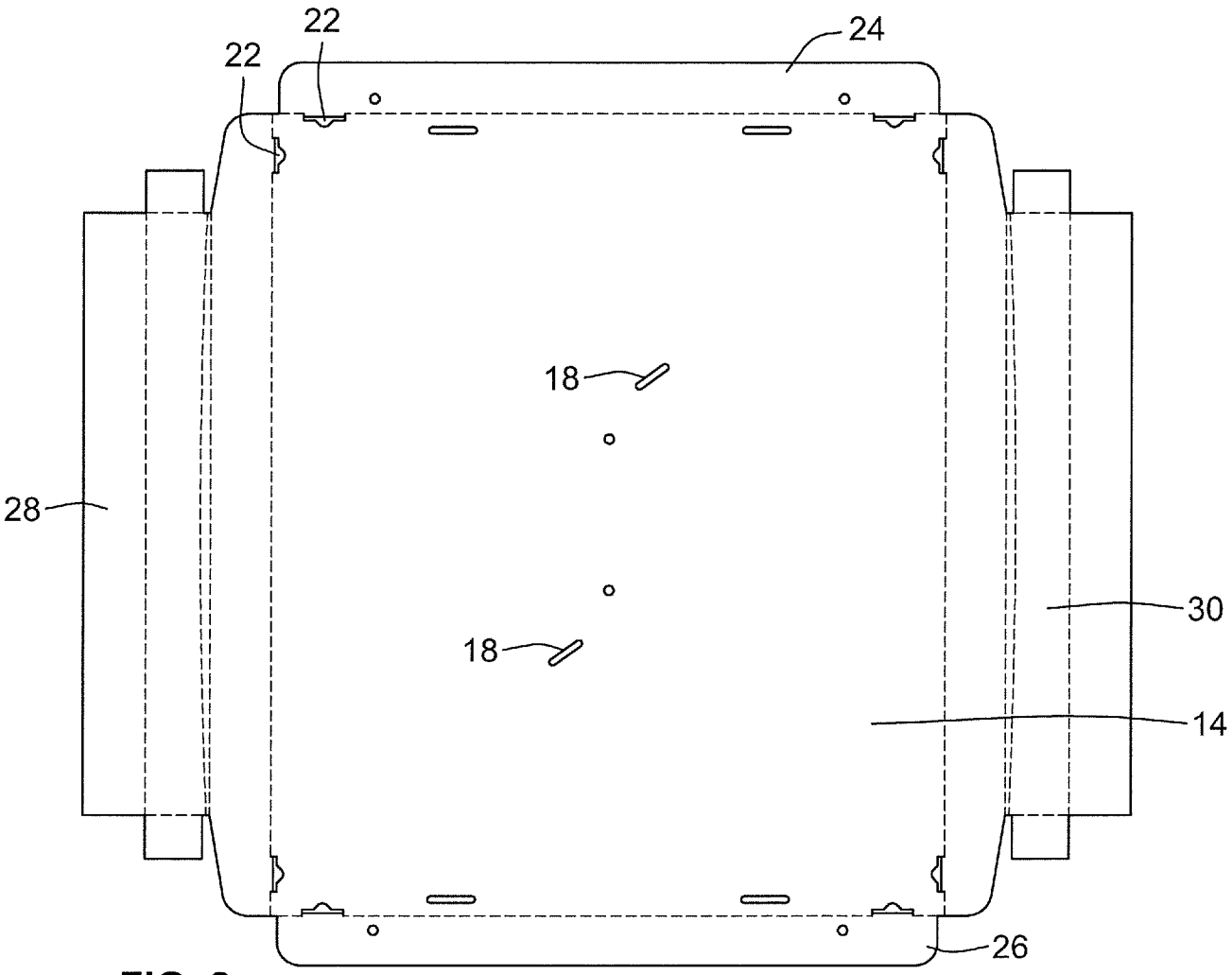
FIG. 2 is a plan view of a blank for a tray bottom component of the pallet display in accordance with the embodiment of FIG. 1 of the present invention.

FIG. 2 shows a blank of material that can be folded to form a base or tray 14 of the pallet 10. The blank 14 includes a centrally located, rectangular bottom wall 16. The bottom wall 16 includes a first slot 18 and a second slot 20 in the interior portion of the bottom wall 16 for use with a divider component as discussed herein.

The bottom wall 16 also includes first and second slots 22 proximate each corner of the bottom wall 16. The corner slots 22 are used to receive upwardly extending tabs from a corner post of a lower pallet 10 when stacked on the lower pallet 10.

The tray 14 includes a first foldable side wall 24 and an opposing second foldable side wall 26. The tray 14 also includes a first foldable end wall 28 and an opposing second foldable end wall 30.

Figure 3:
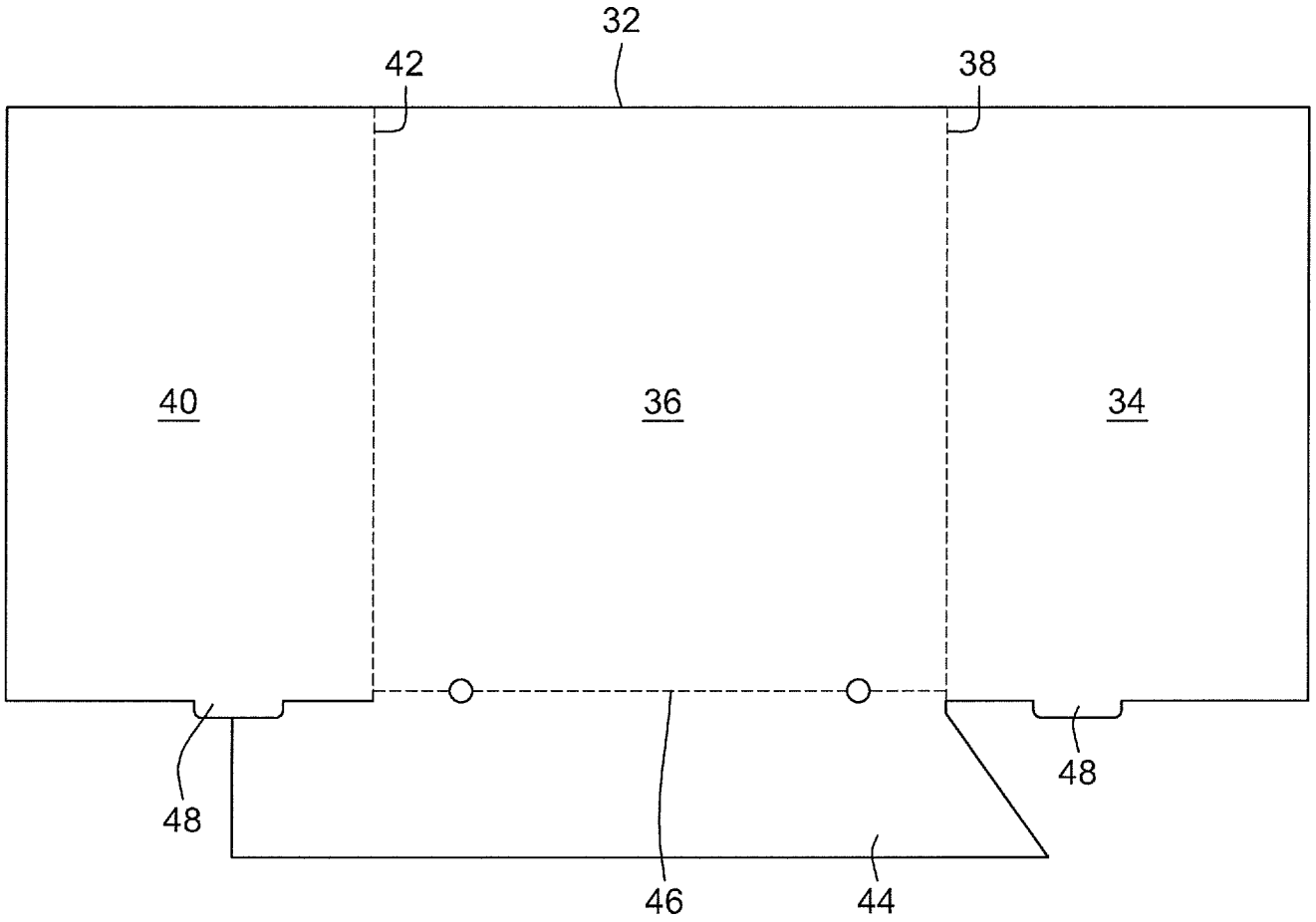
FIG. 3 is a plan view of a blank for a central support and divider panel component of the pallet display in accordance with the embodiment of FIG. 1 of the present invention.

FIG. 3 shows a blank for a divider component 32 of the pallet 10. The divider 32 includes a first panel 34, a second, center panel 36 connected on one side to the first panel 34 by a fold line 38, and a third panel 40 connected to the second panel 36 on an opposing side of the second panel 36 by a fold line 42.

The second panel 36 is connected at its bottom edge to a glue panel 44 by fold line 46 (which is perpendicular to fold lines 38 and 42). The glue panel 44 is used to connect the divider 32 to the bottom wall 16 of the base 14. Additionally, each of the first and third panels 34, 40 of the divider 32 includes a lower tab 48 that can be inserted into the first and second slots 18 and 20 of the bottom wall 16.

Figure 4:
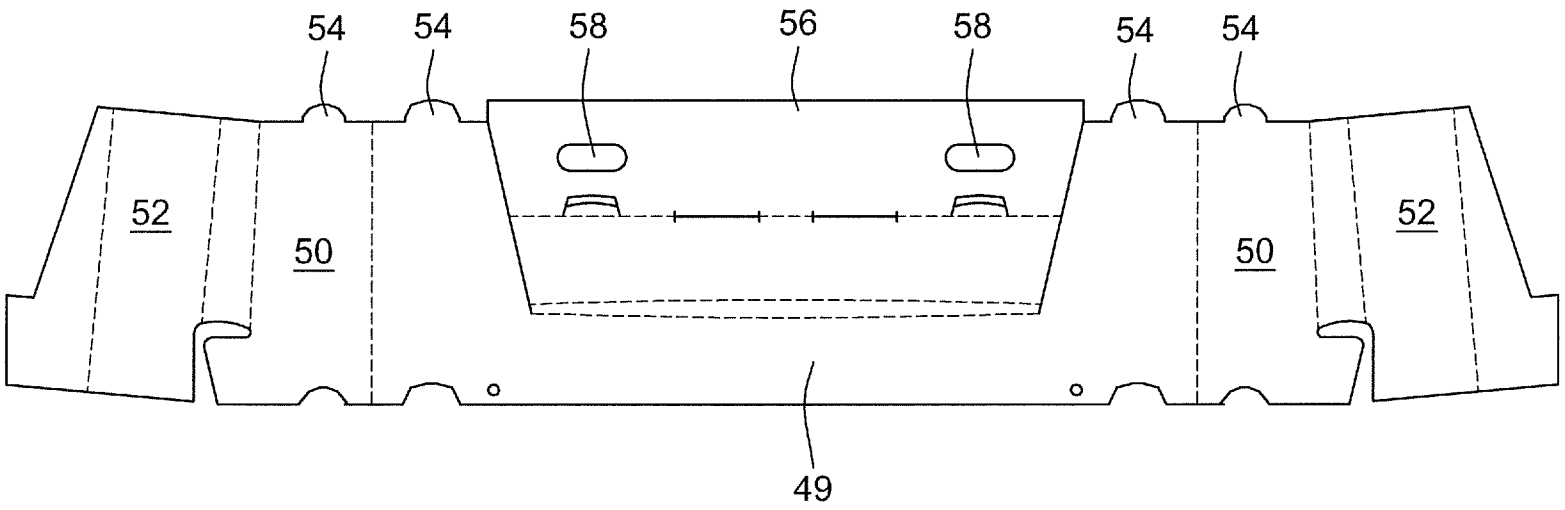
FIG. 4 is a plan view of a blank for a side panel and corner post component of the pallet display in accordance with the embodiment of FIG. 1 of the present invention.

FIG. 4 shows a blank of material that can be formed into a side panel 49. The side panel 49 also includes first and second corner posts 50 integrally formed with the side panel 49. A first side panel 49 can be folded and connected to the first side wall 24, and a second side panel 49 can be folded and connected to the second side wall 26 of the base 14 to provide four corner posts 50 as shown in FIG. 1. Alternatively, the side panels 49 can be connected to the end walls 28, 30.

Referring to FIG. 4, each corner post 50 includes a support panel 52 that is folded into an interior of the pallet 10. The support panel 52 makes each post 50 two layers of material.

Each post 50 includes a first and second tab 54 extending upward. The tabs 54 are positioned to enter the corner slots 22 of a base 14 of a pallet 10 stacked on top of the posts 50. In this manner, the stacked pallets 10 are securely positioned on each other and will not slide.

The side panel 49 also includes a central panel 56 having handle slots 58. This central panel 56 is folded inside along the bottom wall 16 of the tray bottom 14 during assembly of the pallet 10.

Figure 5:
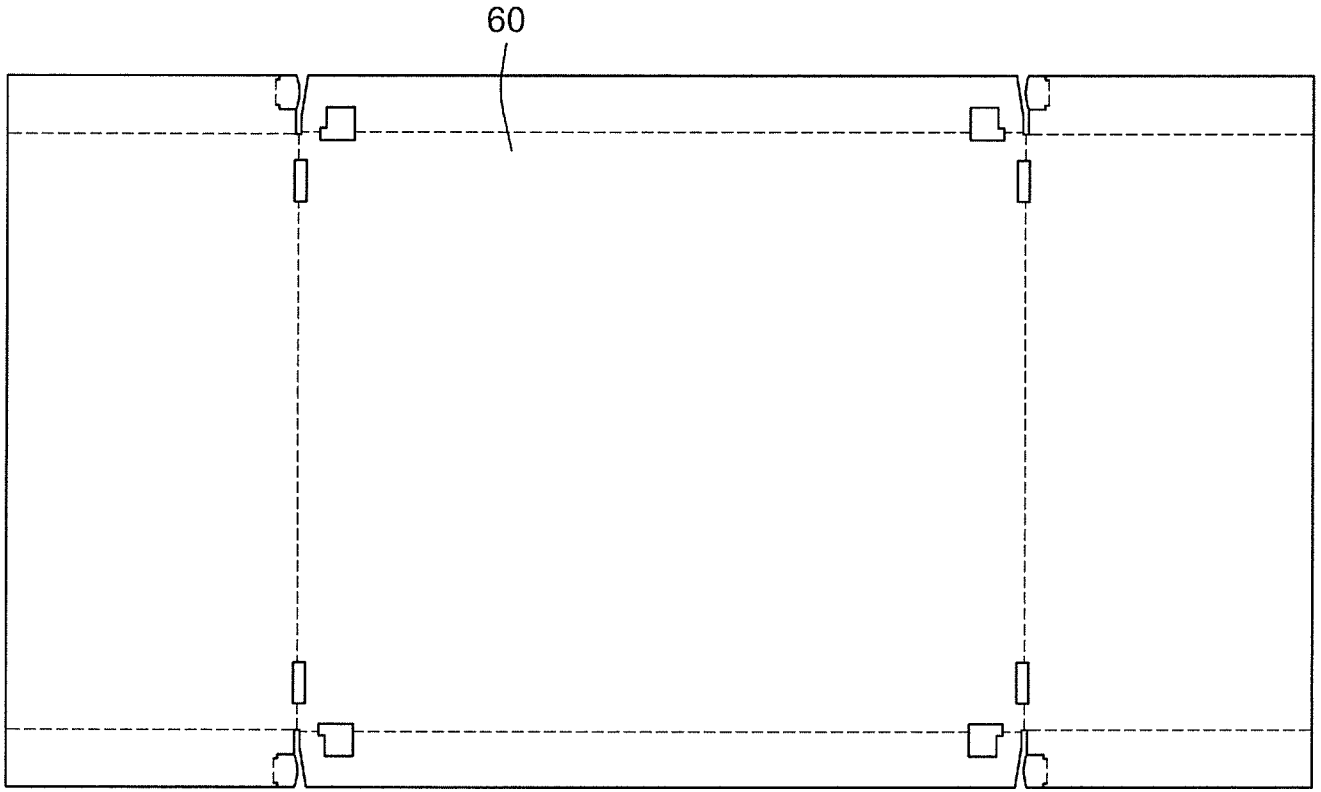
FIG. 5 is a plan view of a blank for a cap component of the pallet display in accordance with the embodiment of FIG. 1 of the present invention.

FIG. 5 shows a blank for forming a cap 60. The cap 60 can be placed on a single pallet 10 or the topmost pallet 10 of a stack of pallets 10.

Figure 6A:
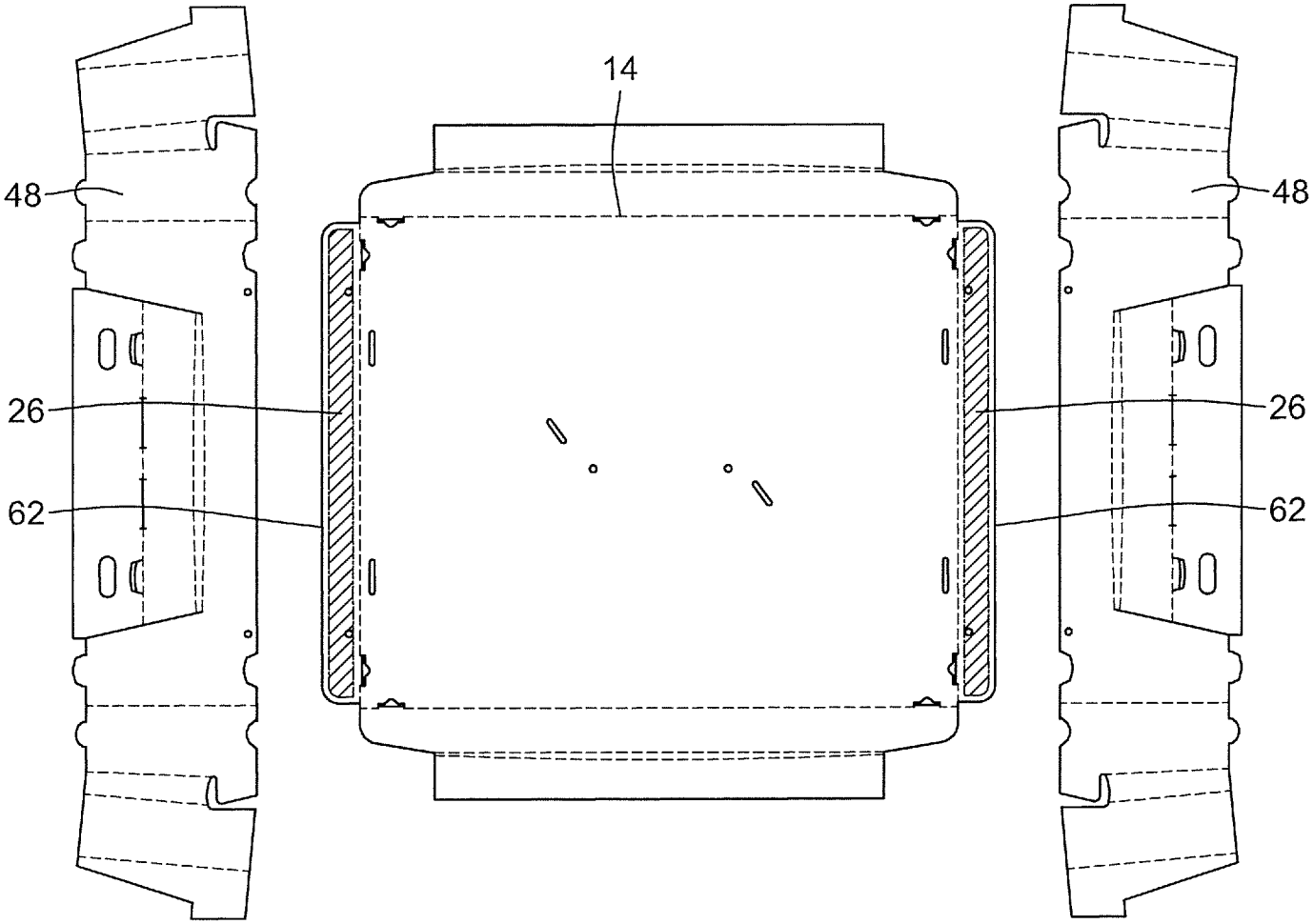
FIGS. 6A-F is a set of views illustrating glue areas for the components of the pallet display of the present invention.
Figure 6F:
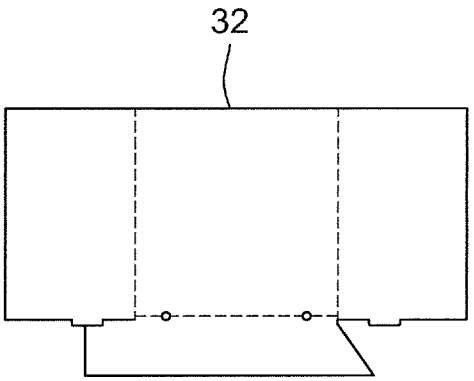
Figure 6B:
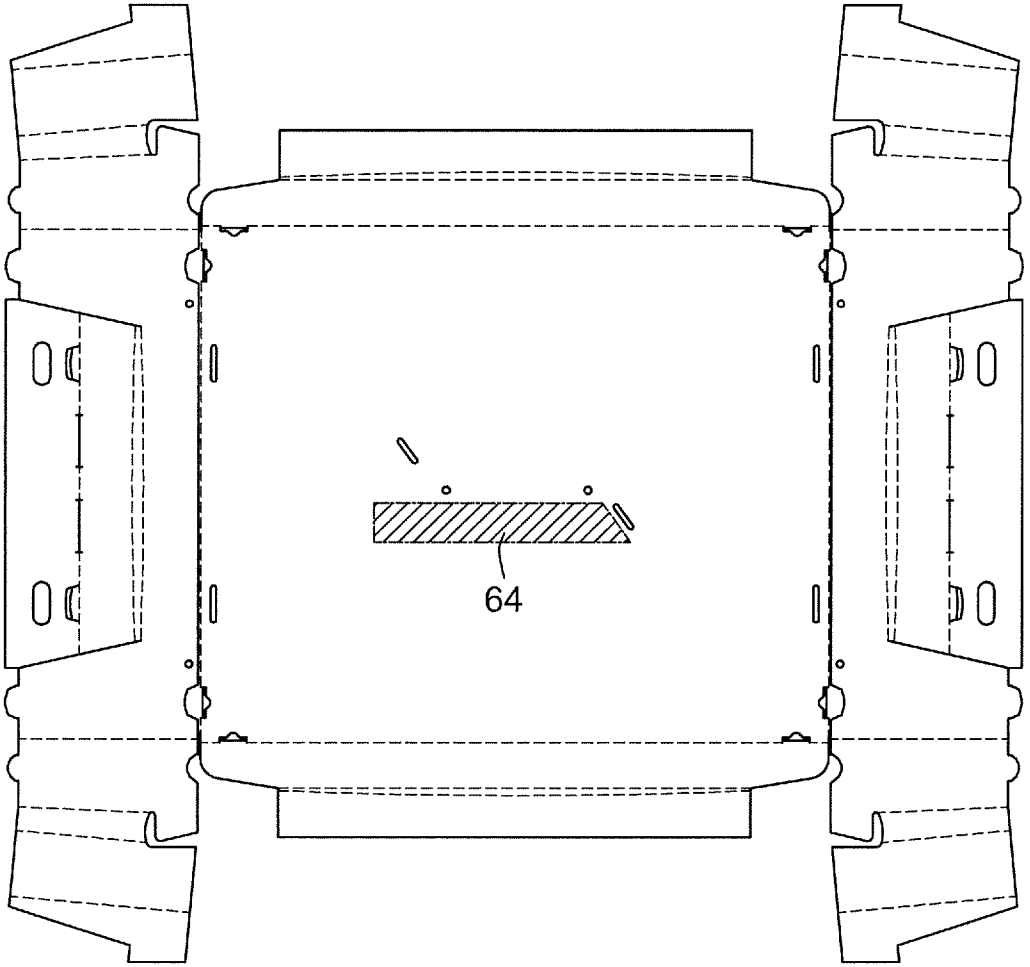
Figure 6C:
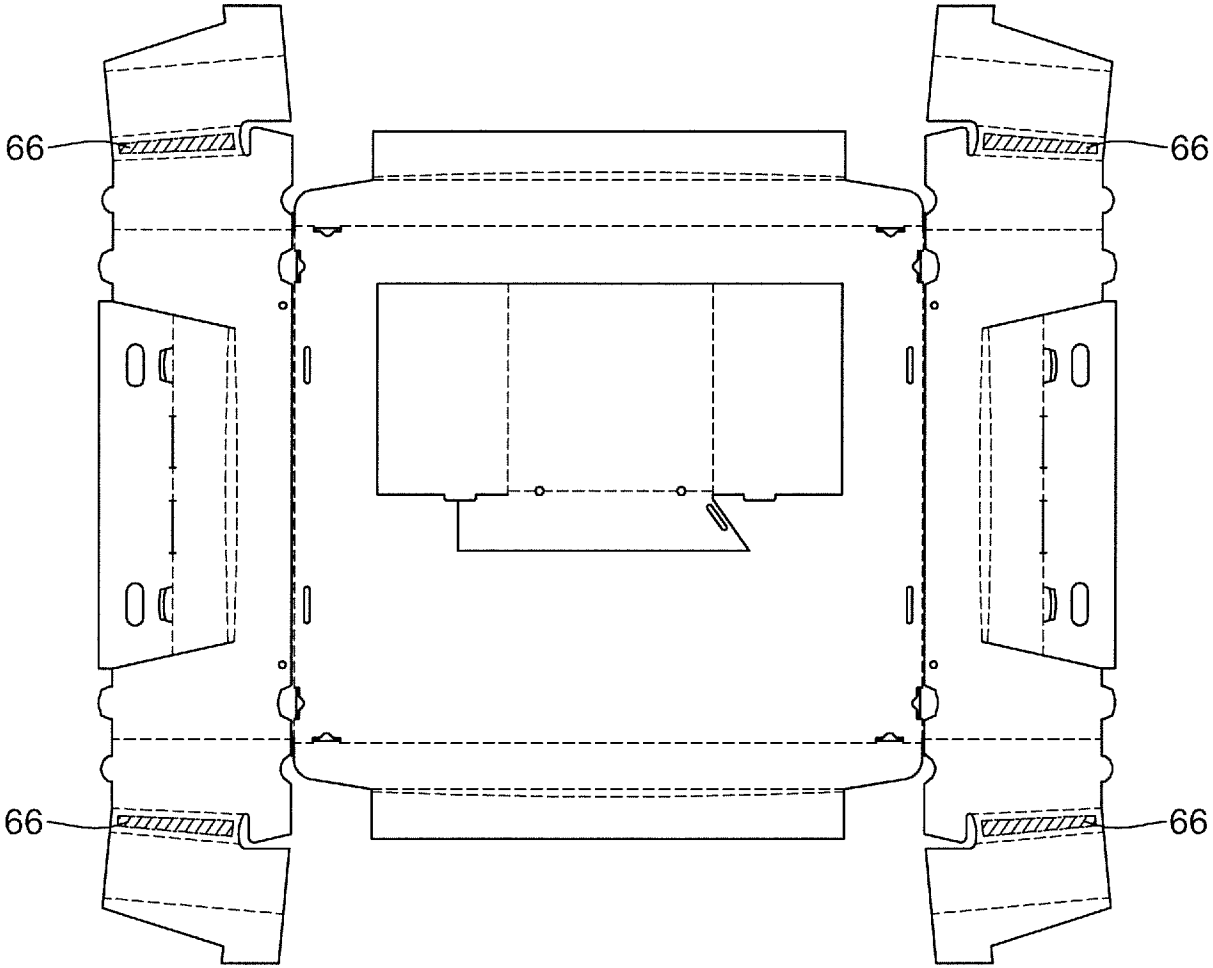
Figure 6D:
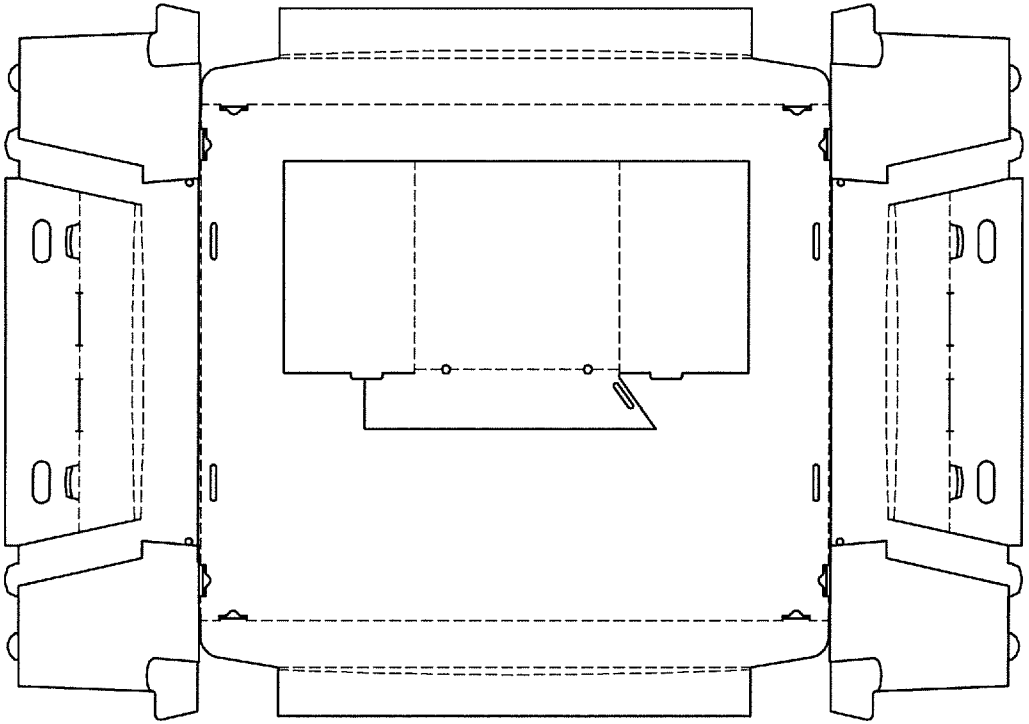
Figure 6E:
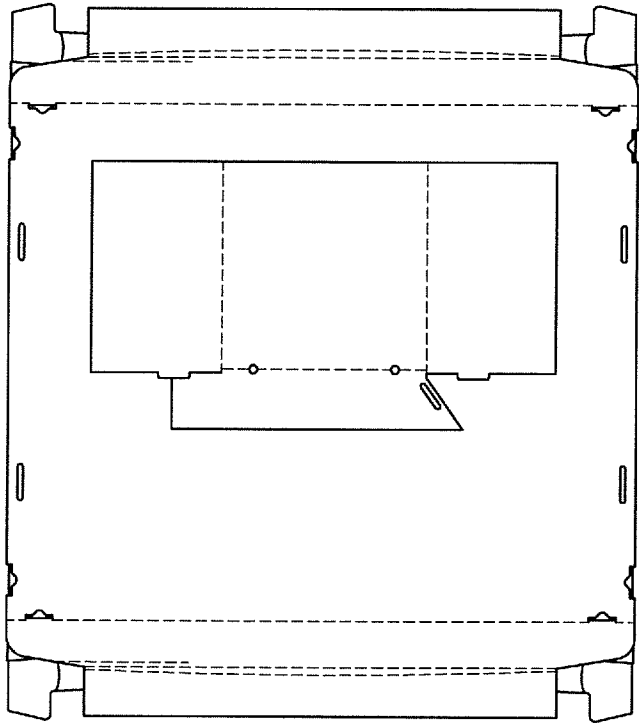

FIGS. 6A-F show glue areas for setting up the pallet 10 from the blanks. As shown at the top of FIG. 6A, the base 14 is provided with a first and second glue strip 62 along an interior side of the first and second side walls 24, 26. These glue strips 62 are used to connect the side panels 49 to the base 14.

The base 14 also includes a central glue strip 64 for connecting the glue panel 44 of the divider 32 to the base 14. Finally, at least one of the panels in the corner posts 54 includes a glue strip 66.

Another embodiment of the invention is illustrated in FIGS. 7-11(*m*). FIGS. 7-10 show blanks for forming components of a pallet display 70 and FIGS. 11(*a*)-11(*m*) show steps for forming the display 70 from the components. The completed pallet or pallet display 70 is shown in FIG. 11(*m*).

Figure 7:
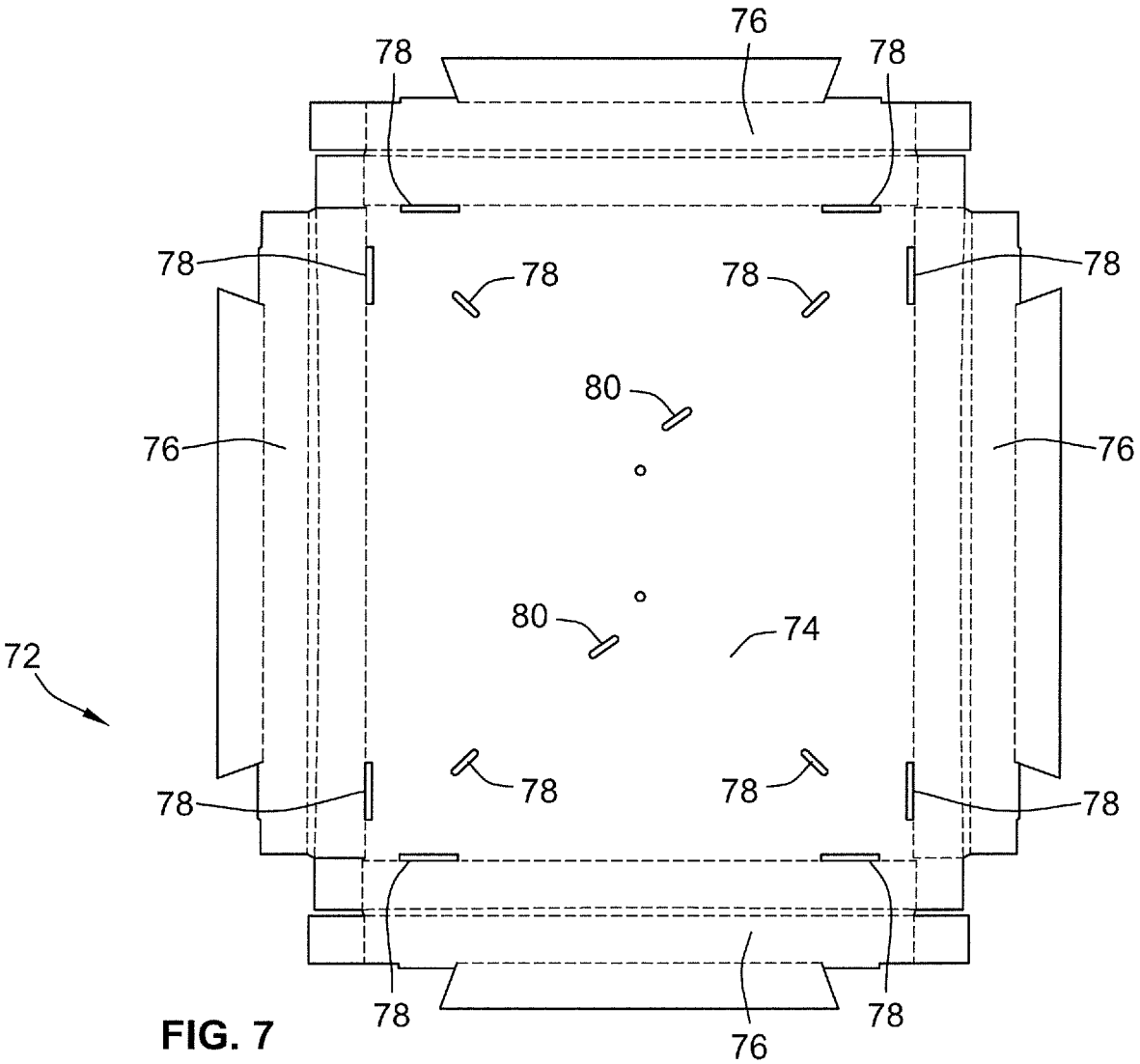
FIG. 7 is a plan view of a blank for a tray bottom component of another embodiment of the pallet display of the present invention.

FIG. 7 provides a blank for forming a base or tray component 72 for the pallet 70. The blank 72 includes a generally rectangular, central bottom wall or support surface 74. On each side of the bottom wall 74 is a plurality of panels that fold into end walls and side walls 76 that extend upward from the edges of the bottom wall 74 (see also e.g., FIG. 11(*m*)).

The bottom wall 74 includes three slots 78 proximate each corner for securing a corner post to the tray (described below). Additionally, the bottom wall 74 also includes two slots 80 for securing a divider to the middle of the tray (described below).

Figure 8:
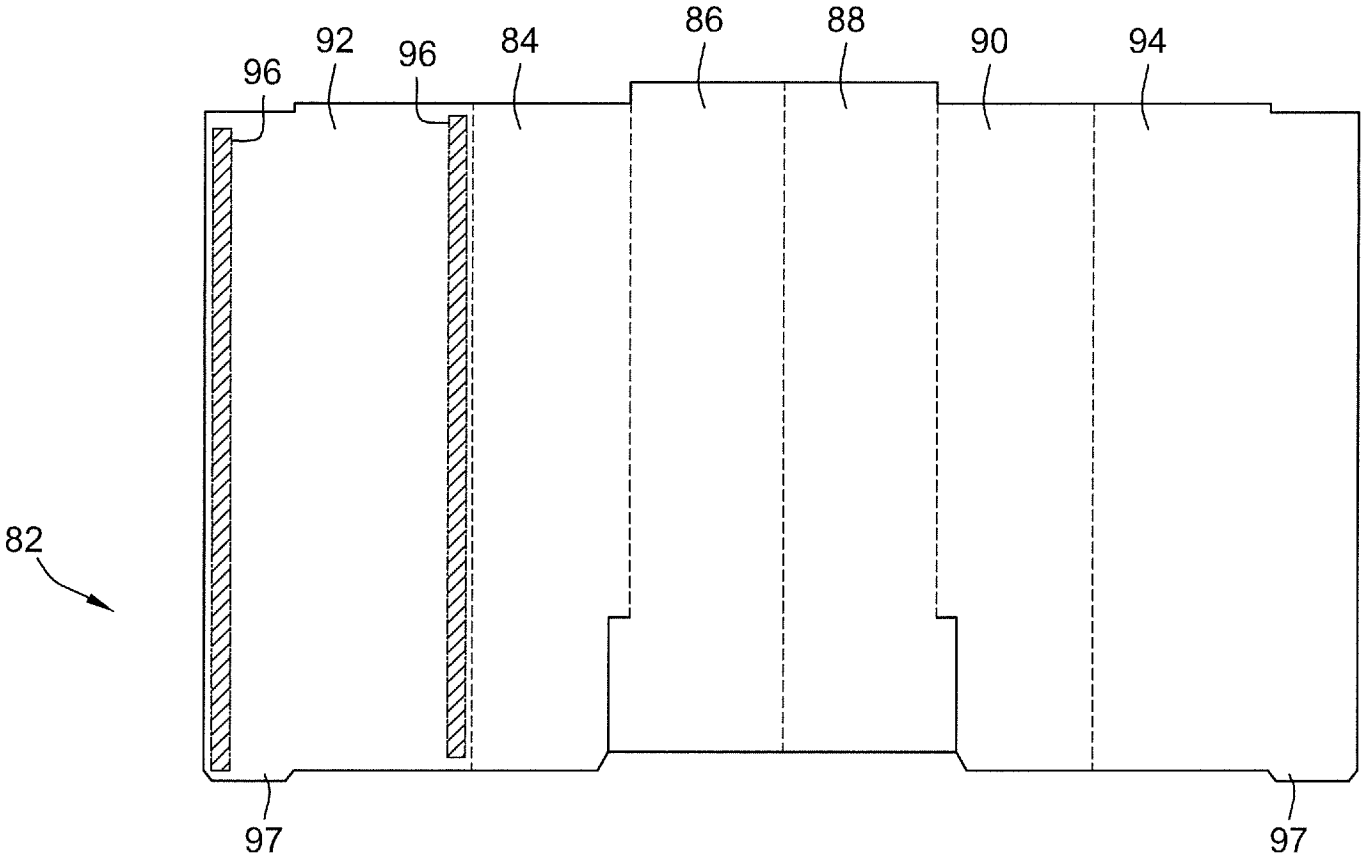
FIG. 8 is a plan view of a blank of a corner support component in accordance with the embodiment of FIG. 7 of the present invention.

A blank for a corner post 82 is shown in FIG. 8 (see also e.g., FIGS. 11(*i*)-11(*m*)). The corner post blank 82 includes four inner panels 84, 86, 88, 90, and a first outer panel 92 and a second outer panel 94. The first outer panel 92 is provided with glue strips 96 (denoted by a plurality of "x"s).

To form the corner post 82, the blank is folded in half so that the glue strips 96 of the first outer panel 92 contact the second outer panel 94. The inner panels 84, 86, 88 and 90 are positioned to have a generally square, hollow cross-sectional shape (see FIG. 11(*j*)), with the glued outer panels 92, 94 forming a flange or wing 98 extending therefrom. Each of the first and second outer panels 92, 94 includes a lower extending portion 97 that forms a tab for the flange 98. The corner post 82 is positioned so that the flange extends toward a center of the bottom wall 74 with the tab 97 fitting into one of the slots 78.

The corner posts 82 of FIG. 8 do not include upwardly extending tabs. However, such tabs can be included and operate in the manner described above with respect to the embodiment of FIGS. 1-6.

Figure 9:
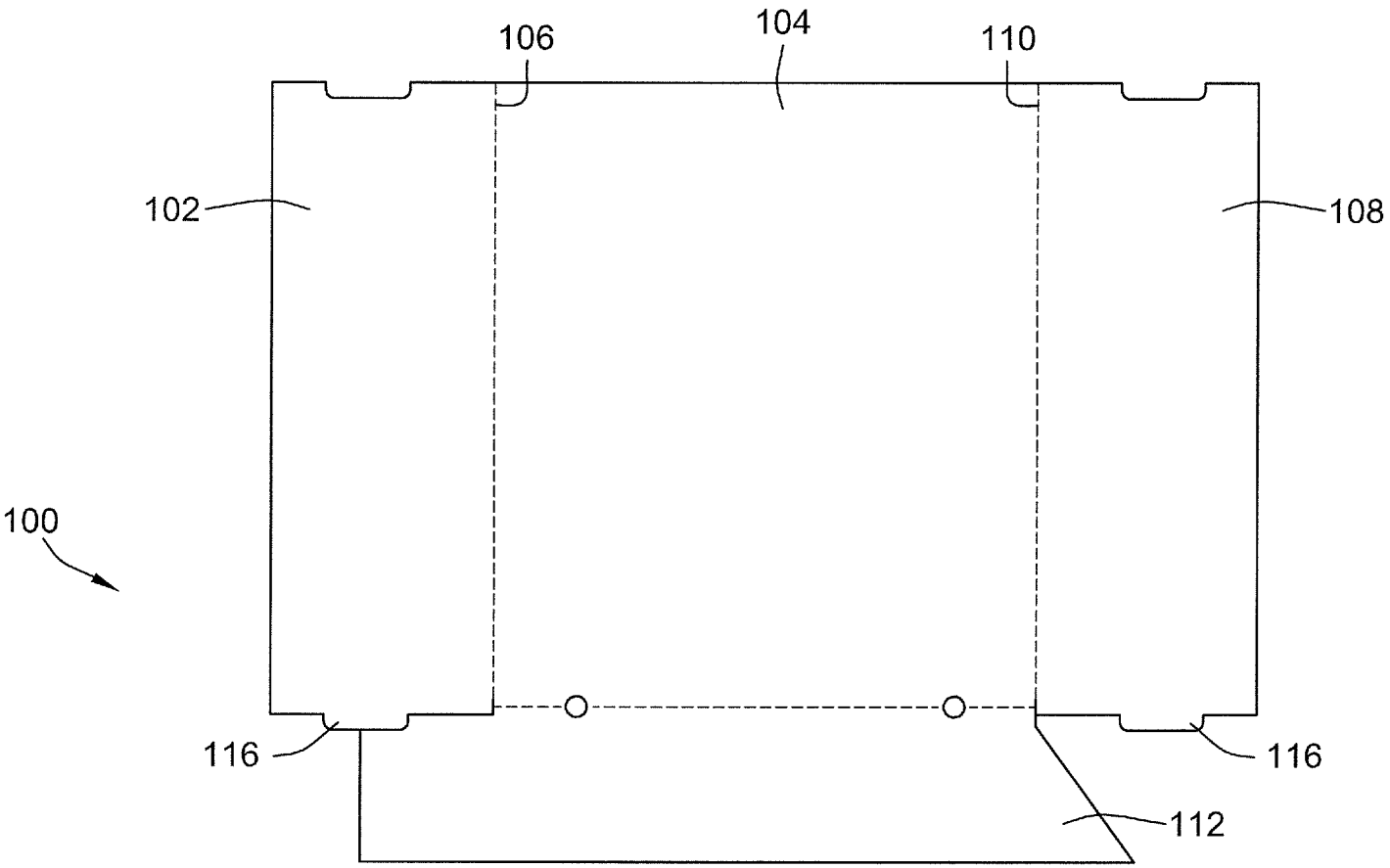
FIG. 9 is a plan view of a blank for a central support and divider panel component of the pallet display in accordance with the embodiment of FIG. 7 of the present invention.

FIG. 9 shows a blank for a divider component 100 of the pallet 10. The divider 100 includes a first panel 102, a second, center panel 104 connected on one side to the first panel 102 by a fold line 106, and a third panel 108 connected to the second panel 104 on an opposing side of the second panel 104 by a fold line 110.

The second panel 104 is connected at its bottom edge to a glue panel 112 by fold line 114 (which is perpendicular to fold lines 106 and 110). The glue panel 112 is used to connect the divider 32 to the bottom wall 16 of the base 14. Additionally, each of the first and third panels 102, 108 of the divider 100 includes a lower tab 116 that can be inserted into the two slots 80 provided for the divider 100 in the bottom wall 74.

Figure 10:
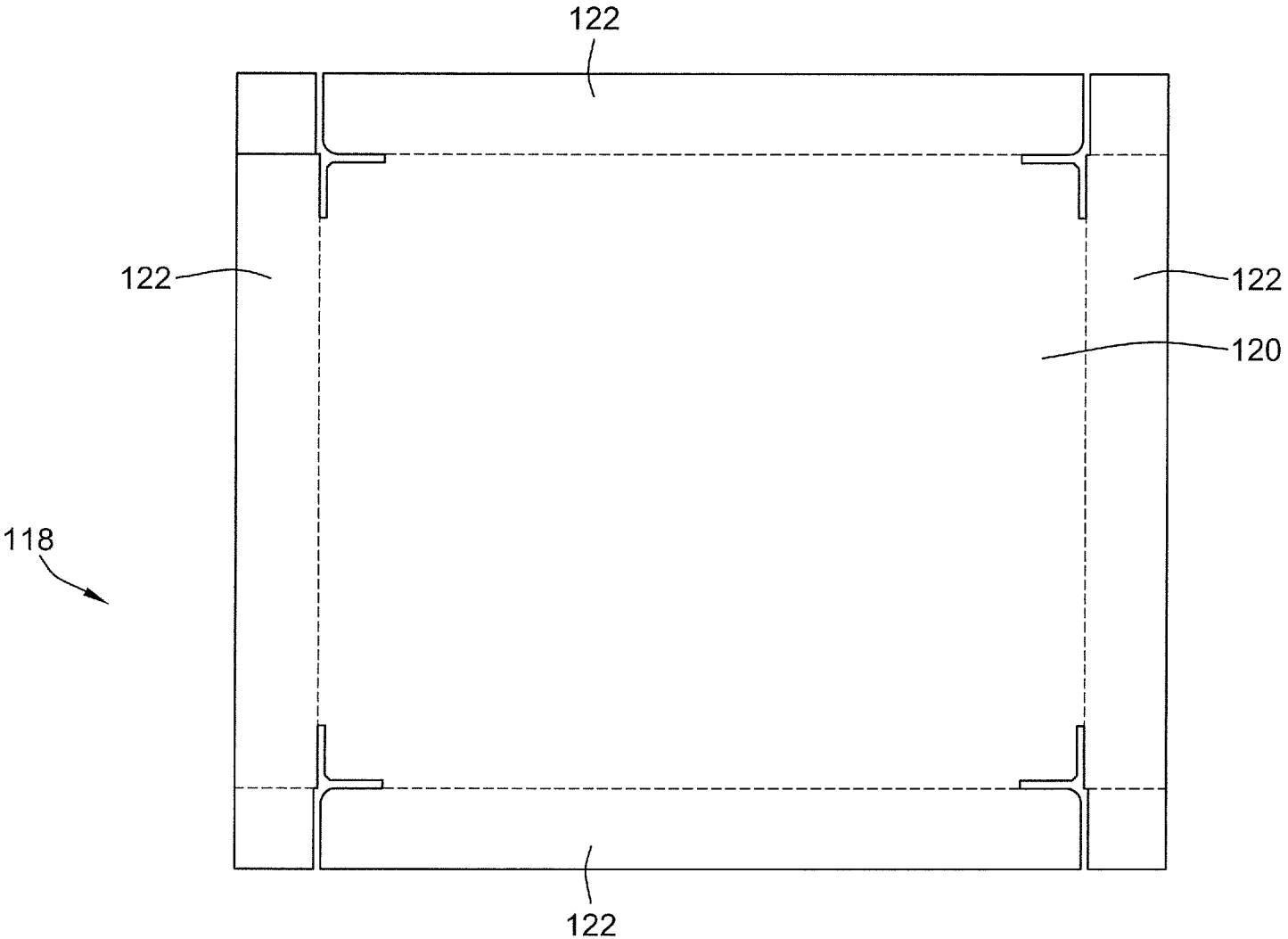
FIG. 10 is a plan view of a blank for a cap component of the pallet display in accordance with the embodiment of FIG. 7 of the present invention; and, FIGS. 11A-11M are perspective views illustrating steps for forming the pallet display from the components of FIGS. 7-10.
Figure 11A:
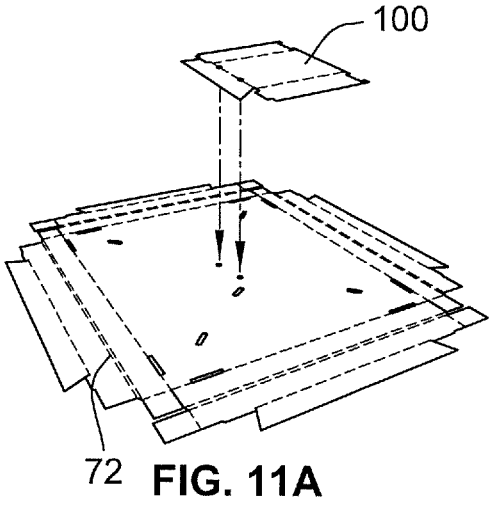
Figure 11B:
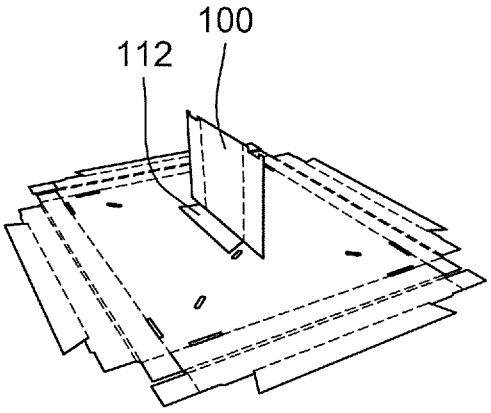
Figure 11C:
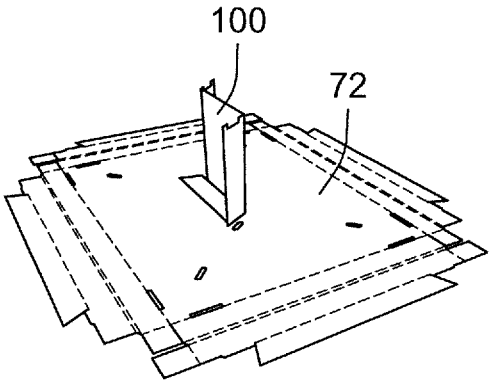
Figure 11D:
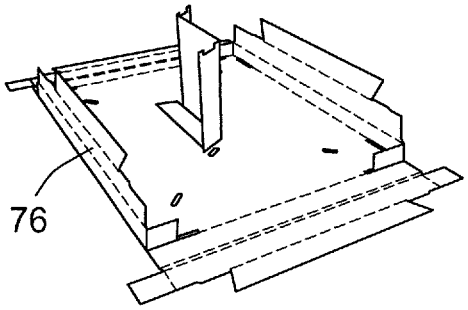
Figure 11E:
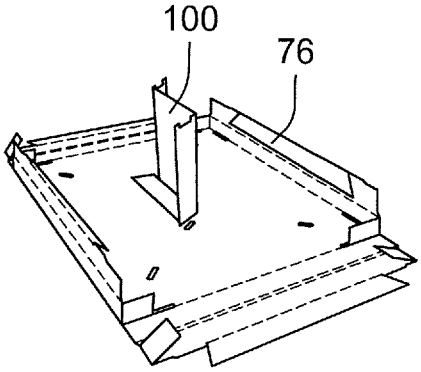
Figure 11F:
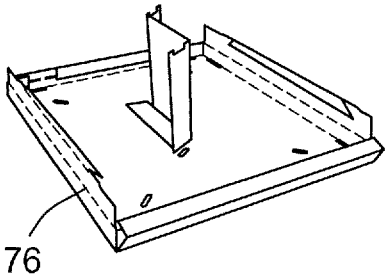
Figure 11G:
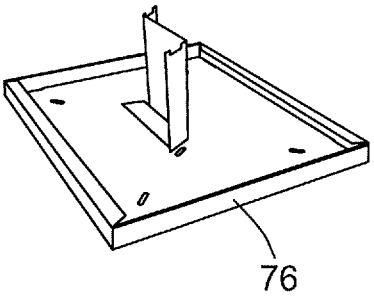
Figure 11H:
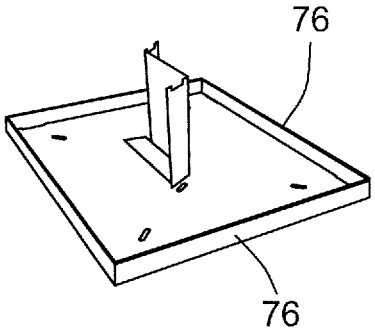
Figure 11I:
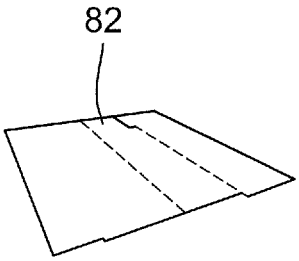
Figure 11J:
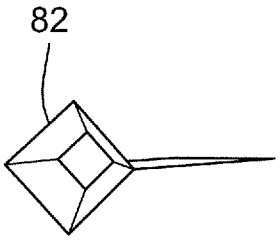
Figure 11K:
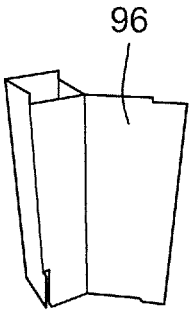
Figure 11L:
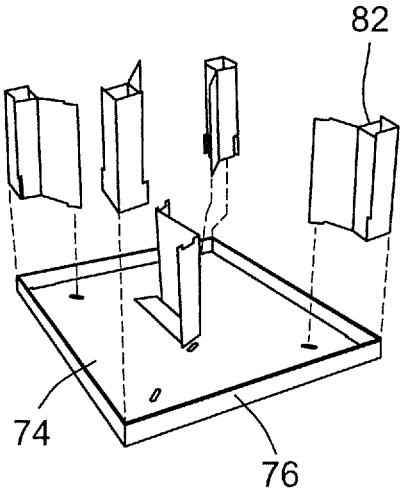
Figure 11M:
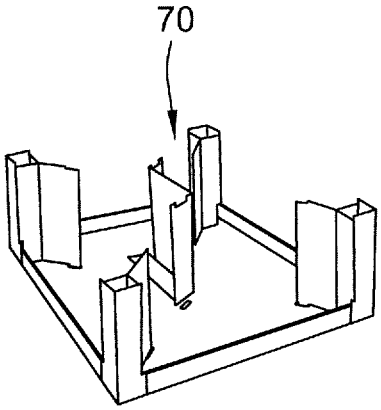

FIG. 10 shows a blank for forming a cap 118. The cap 118 can be placed on a single pallet display 70 or the topmost pallet 70 of a stack of pallets 70. The cap 118 includes a central panel 120 and a plurality of lips or short side walls 122 that can be folded perpendicular to the central panel 120.

Except for the top cap 118, FIGS. 11(*a*)-11(*m*) provide step by step instructions for forming the pallet display 70 from the tray, corner post and divider components 72, 82 and 100, respectively. As shown in FIGS. 11(*a*)-11(*c*), the glue panel 112 of the divider 100 is glued to the bottom wall 74 of the tray 72, and the first and third panels 102, 110 are maneuvered until the tabs 116 are inserted into the slots 80.

As shown in FIGS. 11(*d*)-11(*h*), the panels forming the end walls and side walls 76 are then folded into proper position extending upward around a perimeter of the bottom wall 74 (this can be done before adding the divider 100 if desired). Following the folding of the end walls and side walls 76, the corner posts 82 are formed (as described above), and then positioned in place at each of the corners of the tray 70 as shown in FIGS. 11(*i*)-11(*m*).

Many modifications and variations of the present invention are possible in light of the above teachings. It is, therefore, to be understood within the scope of the appended claims the invention may be protected otherwise than as specifically described.

We claim:

1. A stackable tray comprising:

a tray having a rectangular bottom wall, a first side wall extending upward from a first side of the bottom wall, a second side wall extending upward from a second side of the bottom wall, a first end wall extending upward from a first end of the bottom wall and a second end wall extending upward from a second end of the bottom wall;

a first side panel having a first corner post at a first end extending upward a height greater than a height of the first side wall and second side wall of the tray, and a second corner post extending upward a height greater than the height of the first side wall and second side wall of the tray at a second end, the first corner post having a first tab extending upward from a top of the first corner post and the second corner post having a first tab extending upward from a top of the second corner post; and, a divider extending upward from a central location a height greater than the height of the first side wall and second side wall, wherein the divider includes a first panel, a second panel connected on a first side to the first panel by a fold line and a third panel connected to a second side of the second panel by a fold line, the divider including a glue panel connected to a bottom edge of the divider by a fold line wherein the fold line connecting the glue panel to the divider is perpendicular to the fold line connecting the second panel to the first panel, wherein the first panel of the divider includes a first tab configured to be inserted in a first centrally located slot in the bottom wall, and wherein the divider is connected to the bottom wall of the tray by the glue panel, wherein the bottom wall includes a second slot in the central portion, and wherein the third panel of the divider includes a tab extending downward from a lower portion of the third panel configured to be positioned in the second slot in the central portion of the bottom wall.

2. The stackable tray of claim 1 further comprising a second side panel having a first corner post at a first end and a second corner post at a second end, the first corner post of the second side panel having a first tab extending upward from a top of the first corner post and the second corner post of the second side panel having a first tab extending upward from a top of the second corner post.

3. The stackable tray of claim 1 wherein the first corner post includes a second tab extending upward from the top of the first corner post.

4. The stackable tray of claim 3 wherein the second corner post includes a second tab extending upward from the top of the second corner post.

5. The stackable tray of claim 3 wherein the bottom wall includes a first slot in the first corner and a second slot in the first corner for receiving a first tab and a second tab of a first corner post of a like tray when stacked thereon.

6. The stackable tray of claim 1 wherein the first side panel includes a central panel having handle slots.

7. A stackable tray comprising:

a tray having a rectangular bottom wall, a first side wall extending upward from a first side of the bottom wall, a second side wall extending upward from a second side of the bottom wall, a first end wall extending upward from a first end of the bottom wall and a second end wall extending upward from a second end of the bottom wall;

a first side panel having a first corner post extending upward a height greater than a height of the first side wall and second side wall of the tray at a first end and a second corner post extending upward a height greater than the height of the first side wall and second side wall of the tray at a second end; and, a second side panel having a first corner post extending upward a height greater than a height of the first side wall and second side wall of the tray at a first end and a second corner post extending upward a height greater than the height of the first side wall and second side wall of the tray at a second end; and, a divider extending upward from a central portion of the bottom wall a height greater than the height of the first side wall and second side wall, wherein the divider includes a first panel, a second panel connected on a first side to the first panel by a fold line and a third panel connected to a second side of the second panel by a fold line, the divider including a glue panel connected to a bottom edge of the divider by a fold line wherein the fold line connecting the glue panel to the divider is perpendicular to the fold line connecting the second panel to the first panel, wherein the first panel of the divider includes a first tab configured to be inserted in a first centrally located slot in the bottom wall, and wherein the divider is connected to the bottom wall of the tray by the glue panel, wherein the bottom wall includes a second slot in the central portion, and wherein the third panel of the divider includes a tab extending downward from a lower portion of the third panel configured to be positioned in the second slot in the central portion of the bottom wall.

8. The stackable tray of claim 7 wherein the first corner post of the first side panel includes a first tab extending upward from a top of the first corner post and the second corner post of the first side panel includes a first tab extending upward from a top of the second corner post.

9. The stackable tray of claim 8 wherein the first corner post of the second side panel includes a first tab extending upward from a top of the first corner post and the second corner post of the second side panel includes a first tab extending upward from a top of the second corner post.

10. The stackable tray of claim 7 wherein the first panel of the divider is parallel to the third panel of the divider.

11. The stackable tray of claim 7 wherein the first post includes two outer panels and two inner panels.

12. The stackable tray of claim 7 wherein the tray is formed from paper.

* * * * *